US007879204B2

(12) United States Patent
Funahashi

(10) Patent No.: US 7,879,204 B2
(45) Date of Patent: Feb. 1, 2011

(54) REJUVENATEABLE CATHODIC PROTECTION ANODES FOR REINFORCING STEEL IN CONCRETE AND SOIL

(76) Inventor: Miki Funahashi, 831 Marrone's Ct., West Chester, PA (US) 19382

( * ) Notice: Subject to any disclaimer, the term of this patent is extended or adjusted under 35 U.S.C. 154(b) by 339 days.

(21) Appl. No.: 12/194,252

(22) Filed: Aug. 19, 2008

(65) Prior Publication Data

US 2010/0044218 A1 Feb. 25, 2010

(51) Int. Cl.
*C23F 13/10* (2006.01)
*C23F 13/12* (2006.01)
*C23F 13/16* (2006.01)

(52) U.S. Cl. ..... 204/196.18; 204/196.17; 204/196.3; 204/196.38; 204/196.36; 204/284; 204/291; 204/280

(58) Field of Classification Search ..... 204/196.17, 204/196.18, 196.3, 196.36, 196.38, 280, 204/284, 291
See application file for complete search history.

(56) References Cited

U.S. PATENT DOCUMENTS 6,120,675 A * 9/2000 Hill et al. ..... 205/734
6,332,971 B1 * 12/2001 Hill ..... 205/734
7,338,591 B2 * 3/2008 Vælitalo ..... 205/734
7,749,362 B2 * 7/2010 Glass et al. ..... 204/196.19

OTHER PUBLICATIONS

Ebonex Product Information from Fosroc (believed to have been offered for sale, publicly used, and/or published prior to the filing date of this application).

* cited by examiner

*Primary Examiner*—Bruce F Bell
(74) *Attorney, Agent, or Firm*—Gifford, Krass, Sprinkle, Anderson & Citkowski, P.C.

(57) ABSTRACT

An anode configured for the cathodic protection of reinforced concrete structures and underground metallic structures against corrosion comprises a hollow, mixed-metal-oxide (MMO) coated form, the form having a wall with intentional gaps therethrough. A humectant is disposed in the hollow form, and a conduit between the hollow form and an ambient environment enables gasses produced by the form to escape to the environment while allowing the humectant to be periodically moistened with water or a high pH buffer solution. The form may be composed of titanium, tantalum, zirconium, niobium or alloys thereof, and the MMO coatings may be composed of titanium, tantalum, iridium, ruthenium, palladium, cobalt or mixtures thereof. The form may be a coiled wire or strip, a perforated tube, or other structure having gaps between the interior of the form and the surrounding concrete or soil.

11 Claims, 1 Drawing Sheet

REJUVENATEABLE CATHODIC PROTECTION ANODES FOR REINFORCING STEEL IN CONCRETE AND SOIL

FIELD OF THE INVENTION

This invention relates generally to cathodic protection and, in particular, to rejuvenateable anodes for reinforcing steel in concrete and soil.

BACKGROUND OF THE INVENTION

Cathodic protection is commonly used to control the corrosion of reinforcing steel, particularly in chloride contaminated concrete. Various types of impressed current cathodic protection anodes have been developed for reinforced concrete structures. The anode is one of the most critical components in such systems as it is used to distribute cathodic protection current to the reinforcing steel.

One of the most effective and durable anodes is made of a material which is resistance to corrosion, for example a mixed-metal-oxide (MMO) coated titanium substrate. MMO coated anodes are manufactured by coating a mixture of precious metal oxides on a specially treated precious metal. The coated substrate undergoes multiple thermal treatments at elevated temperatures to gain good bonding properties between the substrate and the coating. Although titanium is widely used as substrate material due to its resistance to corrosion, resistance to chemical attacks and high mechanical strength, other anodes such as tantalum, niobium and zirconium anodes are also used for different applications.

Since the first MMO-coated titanium anode was developed in 1984, many concrete structures have been protected using this material. To install the anodes, however, they must be embedded in concrete or cementitious grout. For example, titanium mesh with a concrete overlay, titanium ribbon or ribbon mesh embedded in cementitious grout in saw-cut slots, or discrete anodes embedded in grout in drilled holes. However, these types of the installation add some burden to the structure and some durability concerns. A useful review of MMO-coated anodes and installation techniques may be found in "Cathodic Protection of Steel in Concrete" By Paul Chess, Taylor & Francis (1998), ISBN 0419230106, the entire content of which is incorporated herein by reference.

Titanium-based anodes typically use iridium- or ruthenium-based precious mixed-metal-oxide (MMO) coatings. Iridium-based coatings are generally used for cathodic protection for reinforcing steel in concrete structures. When iridium-based anodes are operated in chloride-contaminated concrete at low current densities (i.e., less than 110 mA/m$^2$ on the anode surface), oxygen gas is produced. However, if the anode is operated at a higher current density, the production of chlorine gas becomes the main anodic reaction.

If the chlorine gas accumulates at the anode-concrete interface, it becomes hypochloric acid. Once the acid concentration reaches a sufficiently high level, the cement past in the concrete matrix dissolves. The cement paste in the concrete is the electrolyte, which passes the ionic current from the anode to the reinforcing steel. However, if the cement paste is dissolved by the acid, only aggregates exist at the anode-concrete interface. Because most aggregates are not ionically conductive, the resistance of the anode-to-concrete increases significantly. As a result, the anode can no longer discharge the cathodic protection current. Consequently, the current density of iridium-based MMO coated anodes used in concrete is typically limited to 110 mA/m$^2$ to prevent the acid generation.

U.S. Pat. No. 6,332,971 discloses a tubular anode made of titanium suboxide. A hole is formed in concrete that is larger in diameter than the anode, thereby creating a clearance. The clearance is filled with a gas-permeable material through which chlorine gases can be vented, purportedly allowing the anode to be operated with current densities as high as 1 A/m$^2$. However, when anodes operate at the high voltages needed to produce such a high current density in concrete, the water in the concrete around the anode is dried out in a short period of time. As a result, the anode cannot maintain the high current density, and eventually diminishes due to the high resistance.

In some cases, a high-voltage power supply may be used to compensate for the problem of increasing electrical resistance. However, as voltage is increased, moisture at the anode-concrete interface is driven away at a faster rate due to the bipolar characteristics of water. This is the same principle of the electro-osmotic dewatering technique used to dry concrete. Therefore, by increasing the voltage, the resistance increases.

This situation may also be encountered with anodes used in a soil environment. When the impressed current anodes are operated in soil above the water table, the anode-to-soil resistance increases with time. If MMO-coated titanium anodes are used, a back voltage is created. The back voltage is defined as the potential of the MMO anode being more positive or noble as compared to the steel (tanks, pipelines, etc.) in the soil. When the power supply is connected to the anode and the steel to provide cathodic protection, the back voltage must be reversed before the anode discharge the current. This requires operating the anode at a higher voltage, causing the soil to dry faster. As a result, the anode-to-soil resistance increases and reaches the maximum voltage of the power supply. The cathodic protection current decreases and sometimes diminishes altogether. If this happens, the cathodic protection system is no longer effective, even if the anode is designed for a long life (i.e., over 40 years) and is still intact.

Another disadvantage of the anode described in U.S. Pat. No. 6,332,971 is that a bare titanium coil is used to feed the current to the titanium suboxide tubular anode. When the titanium coil is inserted into the tube, the titanium wire makes physical contact to the inside wall of the anode tube. However, since the titanium wire is not metallurgical connected to the anode tube directly, a high contact resistance exists between the wire and the tube anode.

For MMO anodes used in soil, including solid tubular or rod anodes, an electrical cable is used to connect to the anode. For the tubular anode, an expanded anchor which is pre-attached a copper cable is inserted inside the tube for the connection. If the anchor does not expand enough, a high contact resistance to the tubular wall is developed. The inside of the tubular anode is then filled with epoxy to seal the anode connector from water intrusion. However, if any moisture permeates into the connection, the copper cable discharges the cathodic protection current and corrodes in a short period of time. A further concern is physical damage. If the cable is over-stressed, the connection is broken, and once the connection is broken, it is not repairable. As a consequence, connection failures or the development of high resistance at the connection are often serious problems.

SUMMARY OF THE INVENTION

This invention is directed to an anode configured for the cathodic protection of reinforced concrete structures and underground metallic structures against corrosion. The apparatus comprises a hollow, mixed-metal-oxide (MMO) coated form, the form having a wall with intentional gaps therethrough. A humectant is disposed in the hollow form, and a conduit between the hollow form and an ambient environment enables gasses produced by the form to escape to the environment while allowing the humectant to be periodically moistened with water for soil application and a high pH buffer solution for concrete application.

The form may be composed of titanium, tantalum, zirconium, niobium or alloys thereof, and the MMO coatings may be composed of titanium, tantalum, iridium, ruthenium, palladium, cobalt or mixtures thereof. The humectant may be zeolite, a water-absorbed polymer, a super-absorbent material, a starch-based polymer, a hygroscopic salt, carlite or lime plaster. The humectant may further contain a high-pH buffered substance including, for example, sodium ash, calcium hydroxide, potassium hydroxide, sodium hydroxide, trisodium phosphate (TSP), or combinations thereof.

The form may be a coiled wire or strip, a perforated tube, or other structure having gaps between the interior of the form and the surrounding concrete or soil. The form may be sealed with upper and lower end caps to better define the interior. At least a portion of the form may extend into surrounding concrete or soil to facilitate electrical connection. For example, a solid MMO tubular anode or an electrical cable may extend into surrounding concrete or soil.

DETAILED DESCRIPTION OF THE INVENTION

This invention resides in the protection of reinforced concrete structures and underground metallic structures against corrosion using mixed-metal-oxide (MMO) coated anodes and a moisture delivery system to combat increases in electrical resistance over time.

In the preferred embodiment, an MMO-coated titanium wire or strip is coiled into a tubular form for introduction into a drilled hole. However, as will be appreciated by those of skill in this art, other forms and base materials may be used. Indeed, since the anode may be used to protect existing structures and well and new construction, and hollow form may be used.

The gases which evolve on the outer face of the anode surface diffuse inside the form through the openings between the adjacent wires. In the preferred embodiments, substantially all of the gases produced diffuse into the form, thereby obviating the need for gas-permeable backfill material(s).

If the form is made from a coiled wire or strip, the sides are welded lengthwise to add the stiffness and prevent further opening between the wires or the strip after fabrication. Both ends of the tubular coiled anode are sealed by caps. One of the caps holds a plastic tube, and the end of the tube penetrates inside the anode. The plastic tube is used for venting gases and supplying moisture after the anode is installed.

Figure 1:
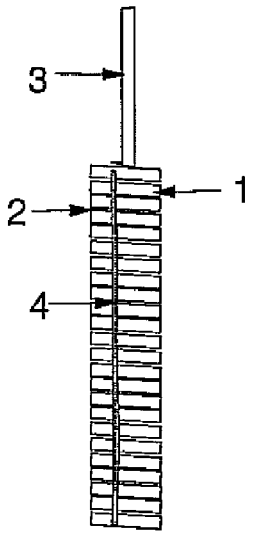
FIG. 1 illustrates a coiled anode according to the invention.
Figure 2:
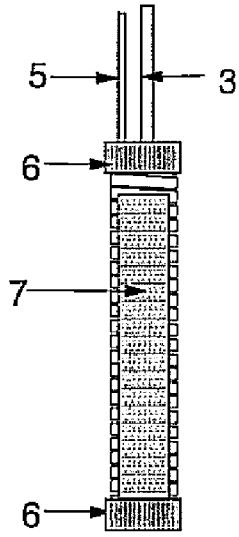
FIG. 2 shows a coiled anode with caps, venting and a water supply tube.
Figure 3:
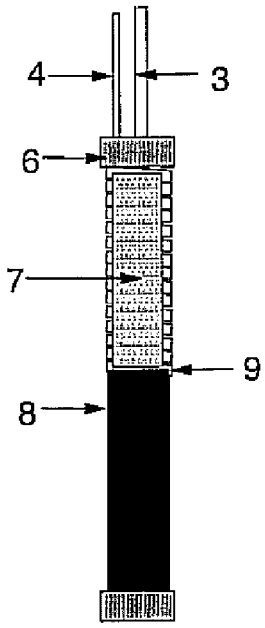
FIG. 3 depicts a combination anode using coiled and solid tubular anodes.

FIG. 1 illustrates a coiled anode according to the invention. FIG. 2 shows a coiled anode with caps, venting and a water supply tube, and FIG. 3 depicts a combination anode using coiled and solid tubular anodes. In these Figures, the following call-outs are used:

1. MMO coated titanium cable or strip.

2. opening.

3. end of coiled titanium wire or strip.

4. welds.

5. gas venting and water supply tube.

6. cap.

7. humectant material or high pH buffered humectant material.

8. MMO solid tubular anode, and

9. weld.

As discussed, the MMO coated anode contains a humectant material, such that when the resistance of the anode-to-soil increases, water or a solution can be injected inside the anode. The water or the solution permeates to the surrounding concrete or soil through the openings in the form. The hemactant material holds a significant amount of moisture and preferably releases it gradually. The humectant material can be zeolite, water absorbed polymer, super-absorbents, starch based polymer, hygroscopic salts, carlite, lime plaster or other water holding materials.

If the anode used in concrete, the humectant material preferably contains a high pH buffered substance, which has the following characteristics:

1. It maintains high pH as a buffer backfill material for a long period of time, including sodium ash, calcium hydroxide, potassium hydroxide, sodium hydroxide, trisodium phosphate (TSP), other high alkaline chemicals and any combinations of these.
2. It is physically stable for a long period of time.

The diameter of the anode form may be in the range of 10 mm to 50 mm, and the length varies based on the current requirement and the physical limitations for the place of the installation. A plastic tube attached to the cap is used to discharge gasses and also used to inject water or a solution when the anode resistance reaches to the maximum voltage of the power supply. The size of the tube ranges from 1 mm to 50 mm depending on the application of the anode.

With a coiled form, one of the ends of the wire or the strip terminates inside the tube, while the other end extends to surrounding concrete or soil through the plastic cap. The end of the wire can be connected to a titanium strip or a wire by metallurgical welding.

For a large size anode, a MMO coiled anode also can be used with a combination of a MMO coated solid titanium tubular anode. The MMO coiled anode is welded to the MMO solid tubular anodes. By positioning the coiled anode upper section of the combination anode, the water or a solution can be injected to the top portion of the anode when the anode resistance becomes high. This reduces the cost of the anode instead of making the entire anode from the coiled wire.

Furthermore, the end of the coiled wire or the strip extends to the outside of the concrete or soil for the connection. This makes the anode element and the current feeder to be a single body. Therefore, the failure of the connection to the anode itself or the development of the high resistance is not concerned. Because the connection to the coiled anode is made outside of the concrete or soil, the inspection of the connection is permitted. If any connection failure occurs, they are readily repaired.

EXAMPLES

A total of four reinforced concrete blocks were (1,000 mm long×200 mm wide×350 mm high) were prepared. Two of the four blocks contained 0.25 percent of chloride on concrete weight, and the other two blocks do not have chlorides.

Sixteen coiled anodes (25 mm in diameter and 100 mm long) were prepared. Eight of the sixteen anodes contains the high pH buffered humectants including zeolite, water absorbed polymer, potassium hydroxide, trisodium phosphate (TSP). The test program using the concrete blocks and the anodes are:

Setup 1: Concrete block without chloride and 4 anodes without humectants.

Setup 2: Concrete block without chloride and 4 anodes containing humectants.

Setup 3: Concrete block with chloride and 4 anodes without humectants.

Setup 4: Concrete block with chloride and 4 anodes containing humectants.

The four anodes in each concrete block were energized at 110 mA/m$^2$, 220 mA/m$^2$, 440 mA/m$^2$ and 800 mA/m$^2$, respectively. Initially, the dry humectants material was used, and at 63 days from the commission, 100 ml of water was injected.

The test specimens were monitored for 120 days, and the results are summarized as follows:

As can be seen from these tables, after the injection of water to the humectant material at 63 days, the voltage increased significantly slower than before by indicating the voltages to maintain all the anode current densities for both chloride and non-chloride contaminated concrete.

In summation, the present invention overcomes the shortcomings of the prior art by allowing gases to be vented out from the anode-concrete interface through the spaces in the anode form. When the anode is operated at a high voltage, the anode-to-concrete or the anode-to-soil resistance increases. By introducing a humectant substance inside the MMO anode, the interface between the anode and the concrete or soil can be rejuvenated by supplying moisture and/or solution(s) to the substance during the anode life when the resistance increases.

Using the gas venting MMO anode with a combination of humectant substance(s), the anode in concrete or soil can be operated at high voltages. In addition, the MMO anode can be Setup 1

| Anode current density | 0 | 20 days | 42 days | 63 days | 64 month | 83 days | 120 days |
|---|---|---|---|---|---|---|---|
| 110 mA/m$^2$ | 0.76 v | 0.82 v | 0.98 v | 1.2 v | 1.2 v | 1.7 v | 2.1 v |
| 220 mA/m$^2$ | 1.4 v | 1.7 v | 2.1 v | 2.8 v | 3.2 v | 3.9 v | 4.3 v |
| 440 mA/m$^2$ | 2.7 v | 3.2 v | 4.3 v | 5.2 v | 6.7 v | 7.6 v | 8.9 v |
| 800 mA/m$^2$ | 5.1 v | 6.2 v | 8.7 v | 11.2 v | 11.4 v | 14.8 v | 18.1 v |

Setup 2

| Anode current density | 0 | 20 days | 42 days | 63 days (after injection) | 64 month (after injection) | 83 days | 120 days |
|---|---|---|---|---|---|---|---|
| 110 mA/m$^2$ | 0.77 v | 0.85 v | 1.2 v | 1.3 v | 0.32 v | 0.34 v | 0.39 v |
| 220 mA/m$^2$ | 1.6 v | 1.9 v | 2.2 v | 2.4 v | 0.67 v | 0.71 v | 0.80 v |
| 440 mA/m$^2$ | 2.9 v | 3.5 v | 4.8 v | 5.7 v | 1.2 v | 1.4 v | 1.6 v |
| 800 mA/m$^2$ | 4.9 v | 5.3 v | 7.8 v | 10.2 v | 3.1 v | 3.7 v | 4.1 v |

Setup 3

| Anode current density | 0 | 20 days | 42 days | 63 days | 64 month | 83 days | 120 days |
|---|---|---|---|---|---|---|---|
| 110 mA/m$^2$ | 0.41 v | 0.44 v | 0.49 v | 0.67 v | 0.67 v | 0.74 v | 0.79 v |
| 220 mA/m$^2$ | 0.72 v | 0.81 v | 0.90 v | 1.1 v | 1.1 v | 1.3 v | 1.5 v |
| 440 mA/m$^2$ | 1.4 v | 1.7 v | 2.2 v | 2.9 v | 3.0 v | 3.9 v | 7.1 v |
| 800 mA/m$^2$ | 2.3 v | 2.9 v | 4.7 v | 7.2 v | 7.4 v | 8.7 v | 11.1 v |

Setup 4

| Anode current density | 0 | 20 days | 42 days | 63 days (before injection) | 64 month (after injection) | 83 days | 120 days |
|---|---|---|---|---|---|---|---|
| 110 mA/m$^2$ | 0.51 v | 0.56 v | 0.62 v | 0.63 v | 0.22 v | 0.24 v | 0.29 v |
| 220 mA/m$^2$ | 1.0 v | 1.1 v | 1.2 v | 1.4 v | 0.38 v | 0.41 v | 0.44 v |
| 440 mA/m$^2$ | 1.2 v | 2.7 v | 3.8 v | 4.9 v | 0.65 v | 0.71 v | 0.81 v |
| 800 mA/m$^2$ | 2.1 v | 3.1 v | 3.9 v | 7.0 v | 1.2 v | 1.4 v | 1.6 v |

used in concrete at a current density without generating acid, thereby minimizing connection failures.

I claim:

1. An anode configured for the cathodic protection of reinforced concrete structures and underground metallic structures against corrosion, comprising:

a hollow, mixed-metal-oxide (MMO) coated form, the form having a wall with intentional gaps therethrough;

a humectant disposed in the hollow form; and a conduit between the hollow form and an ambient environment, the conduit enabling gasses produced by the form to escape to the environment and allowing the humectant to be periodically moistened with water or a high pH buffer solution.

2. The anode of claim 1, wherein the form is composed of titanium, tantalum, zirconium, niobium or alloys thereof.

3. The anode of claim 1, wherein the MMO coatings are composed of titanium, tantalum, iridium, ruthenium, palladium, cobalt or mixtures thereof.

4. The anode of claim 1, wherein the humectant is zeolite, a water-absorbed polymer, a super-absorbent material, a starch-based polymer, a hygroscopic salt, carlite or lime plaster.

5. The anode of claim 1, wherein the humectant contains a high-pH buffered substance.

6. The anode of claim 1, wherein the humectant contains sodium ash, calcium hydroxide, potassium hydroxide, sodium hydroxide, trisodium phosphate (TSP), or combinations thereof.

7. The anode of claim 1, wherein the form is made of a coiled wire or strip.

8. The anode of claim 1, wherein the form is made of a perforated tube.

9. The anode of claim 1, wherein the form is sealed with upper and lower end caps.

10. The anode of claim 1, wherein at least a portion of the form extends into surrounding concrete or soil to facilitate electrical connection.

11. The anode of claim 1, further including a solid MMO tubular anode or an electrical cable extending into surrounding concrete or soil.

* * * * *